US011906269B2

(12) United States Patent
Lin et al.

(10) Patent No.: US 11,906,269 B2
(45) Date of Patent: Feb. 20, 2024

(54) TURNING SUPPORT FOR SIGHT

(71) Applicant: ZHUHAI MEFO OPTICAL INSTRUMENTS CO., LTD., Zhuhai (CN)

(72) Inventors: Dayun Lin, Zhuhai (CN); Hui Yang, Zhuhai (CN); Xiping Yu, Zhuhai (CN)

(73) Assignee: ZHUHAI MEFO OPTICAL INSTRUMENTS CO., LTD., Zhuhai (CN)

( * ) Notice: Subject to any disclaimer, the term of this patent is extended or adjusted under 35 U.S.C. 154(b) by 0 days.

(21) Appl. No.: 18/138,152

(22) Filed: Apr. 24, 2023

(65) Prior Publication Data

US 2024/0003661 A1 Jan. 4, 2024

Related U.S. Application Data

(63) Continuation of application No. PCT/CN2021/135597, filed on Dec. 6, 2021.

(30) Foreign Application Priority Data

Dec. 8, 2020 (CN) ..... 202022979573.7

(51) Int. Cl.
*F41G 11/00* (2006.01)

(52) U.S. Cl.
CPC ..... *F41G 11/001* (2013.01)

(58) Field of Classification Search
CPC ..... F41G 11/001; F41G 11/005; F41G 11/007
See application file for complete search history.

(56) References Cited

U.S. PATENT DOCUMENTS

| | | | | |
|---|---|---|---|---|
| 2,644,237 | A * | 7/1953 | Pachmayr | F41G 11/008 42/128 |
| 8,510,983 | B2 * | 8/2013 | Larue | F41G 11/003 42/124 |
| 8,935,875 | B2 * | 1/2015 | Collin | F41G 11/003 42/124 |
| 9,417,034 | B1 * | 8/2016 | Swan | F41G 11/007 |
| 10,627,191 | B1 * | 4/2020 | Fischer | F41G 11/008 |

(Continued)

FOREIGN PATENT DOCUMENTS

| | | |
|---|---|---|
| CN | 101957157 A | 1/2011 |
| CN | 108827075 A | 11/2018 |

(Continued)

*Primary Examiner* — Joshua E Freeman
(74) *Attorney, Agent, or Firm* — Bayramoglu Law Offices LLC

(57) ABSTRACT

A turning support for a sight includes a mounting portion, a base, and a rotating shaft. The mounting portion is hinged with the base through the rotating shaft, and a lower surface of the mounting portion is located above the base, such that the mounting portion is turned about the rotating shaft between a use position and a storage position. An upper surface of the mounting portion is structurally connected to a sight, and a lower surface of the base is structurally connected to a guide rail of a firearm. A first magnet is arranged on the lower surface of the mounting portion, and a second magnet is arranged on the upper surface of the base. When the lower surface of the mounting portion is turned to the use position toward the base, the first magnet and the second magnet are attracted to each other.

9 Claims, 4 Drawing Sheets

(56) References Cited

U.S. PATENT DOCUMENTS

| | | | | |
|---|---|---|---|---|
| 10,627,192 | B1 * | 4/2020 | Fischer | F41G 11/008 |
| 10,634,456 | B1 * | 4/2020 | Fischer | F41G 11/003 |
| D969,958 | S * | 11/2022 | Hamilton | D22/109 |
| 11,561,068 | B1 * | 1/2023 | Carter | F41G 11/008 |
| D995,701 | S * | 8/2023 | Zimmer | D22/110 |
| 2011/0296732 | A1 * | 12/2011 | Carlson | F41G 11/008 42/90 |
| 2013/0055614 | A1 * | 3/2013 | Finnegan | F41C 27/00 42/90 |
| 2013/0160345 | A1 * | 6/2013 | Li | F41G 11/003 42/111 |
| 2013/0185985 | A1 * | 7/2013 | Ballard | F41G 1/00 42/148 |
| 2014/0137457 | A1 * | 5/2014 | Collin | F41G 11/003 42/90 |

FOREIGN PATENT DOCUMENTS

| | | | |
|---|---|---|---|
| CN | 109269348 | A | 1/2019 |
| CN | 208936868 | U | 6/2019 |
| CN | 209991858 | U | 1/2020 |

* cited by examiner

TURNING SUPPORT FOR SIGHT

CROSS-REFERENCE TO RELATED APPLICATION

The application is the Continuation-in-part Application of International Application No. PCT/CN2021/135597, filed on Dec. 6, 2021, which is based on and claims priority on Chinese patent application No. 202022979573.7, filed on Dec. 8, 2020, the entire contents of which are incorporated herein by reference.

TECHNICAL FIELD

The present disclosure relates to the technical field of aiming devices, in particular to a turning support for a sight.

BACKGROUND

The turning support is widely used as an auxiliary aiming tool of a firearm and is specifically used to quickly switch a sight between a use position and a storage position. The sight, when needed, is switched through the turning support to the use position so that the sight is ready for aiming. The sight, when no longer needed, is switched through the turning support to the storage position so that the view of a shooter is not obstructed by the sight. For example, the US Patent No. U.S. Pat. No. 8,935,875B2 discloses a pivoting mount for a weapon accessory. The pivoting mount includes a base attached to a weapon, an upper member for mounting a sight, and a pivot for pivoting. The upper member is rotationally connected to the base through the pivot so that the upper member pivotally rotates around the pivot between the use position and the storage position. However, the junction between the upper member and the pivot may be worn due to frequent use. In this case, the upper member becomes loose, causing vibration of the firearm when fired, and accordingly, the upper member may not be kept at the use position under the influence of vibration. Inevitably, the sight cannot be accurately kept at the use position, leading to a reduction in both the aiming accuracy of the sight and the shooting accuracy. In view of the foregoing defects, it is necessary to improve the existing turning support.

SUMMARY

The technical problem to be solved by the present disclosure is to provide a turning support for a sight, which can enable the sight to be accurately kept at a preset position.

The present disclosure adopts the following technical solution. A turning support for a sight includes a mounting portion, a base, and a rotating shaft. The mounting portion is hinged with the base through the rotating shaft. A lower surface of the mounting portion is located above the base, such that the mounting portion can be turned around the rotating shaft between a use position and a storage position. An upper surface of the mounting portion can be structurally connected to a sight, and a lower surface of the base can be structurally connected to a guide rail of a firearm. A first magnet is arranged on the lower surface of the mounting portion, and a second magnet is arranged on the upper surface of the base. When the lower surface of the mounting portion is turned to the use position in a direction towards the base, the first magnet and the second magnet are attracted to each other.

Compared with the prior art, the turning support for a sight can accurately maintain the mounting portion at the use position through a magnetic attractive force generated by the mutual attraction of the first magnet on the lower surface of the mounting portion and the second magnet on the upper surface of the base. In this way, the mounting portion is prevented from being dislocated, such that the accuracy in the use of the turning support and the degree of accuracy of the sight are both improved.

Preferably, the surfaces of the first magnet and the second magnet that are attracted to each other are inclined and parallel to each other.

Further, an adjustable fine adjustment screw is arranged on the upper surface of the base. The top end of the fine adjustment screw protrudes from the upper surface of the base. A stopper is arranged on the lower surface of the mounting portion. When the lower surface of the mounting portion is turned to the use position in the direction towards the base, the stopper abuts against the top end of the fine adjustment screw.

Further, the mounting portion or the base is detachably connected to the rotating shaft.

Further, supporting portions extending upwards are arranged on the upper surface of the base. A pivoting portion is arranged on a side surface of the mounting portion. The rotating shaft runs through the supporting portions and the pivoting portion, such that the mounting portion can be turned around the rotating shaft relative to the base.

In an embodiment, the turning support for a sight further includes an elastic piece with a fixed end and an unfixed end. The fixed end is fixed to the upper surface of the base, and the unfixed end is provided with a deformable protrusion. The pivoting portion is provided with a first groove and a second groove which are open outwards. When the mounting portion is located at the use position, the protrusion is inserted into the first groove; when the mounting portion is located at the storage position, the protrusion is inserted into the second groove.

Preferably, a mounting hole is formed in the upper surface of the base, and the fixed end is fixedly connected to the mounting hole by means of an adhesive.

Further, the pivoting portion is provided with a flange protruding outward. When the mounting portion is located at the storage position, the flange abuts against the base.

Further, a side surface of the mounting portion that is opposite to the rotating shaft is provided with an outwardly open recess, such that the mounting portion can be shifted to turn about the rotating shaft away from the base.

The present disclosure further provides a sight. The sight includes the turning support described above.

BRIEF DESCRIPTION OF THE DRAWINGS

To more clearly illustrate the technical solutions of the embodiments of the present disclosure, the accompanying drawings of the embodiments will be briefly described below. The accompanying drawings in the following description are only some embodiments of the present disclosure and are not intended to limit the present disclosure.

DETAILED DESCRIPTION OF THE EMBODIMENTS

It should be noted that terms, such as "first", "second", and similar words, used herein do not denote any order, quantity, or importance but are merely intended to distinguish between different constituents. "Upper", "lower", "left", "right", "front", "rear", "top", "bottom", and the like used herein are only used to indicate a relative positional relationship, and when the absolute position of the described object is changed, the relative positional relationship may also be changed accordingly.

As described in the background, with an increase in the number of uses, a sight may not be accurately kept at a use position when the existing turning support for a sight is subjected to vibration, thereby reducing the aiming accuracy of the sight and affecting the shooting accuracy. Thus, it is necessary to improve the existing turning support for a sight.

To better describe the technical solution of the present disclosure, a turning support for a sight in an embodiment of the present disclosure is described with reference to FIG. 1 to FIG. 8.

Figure 1:
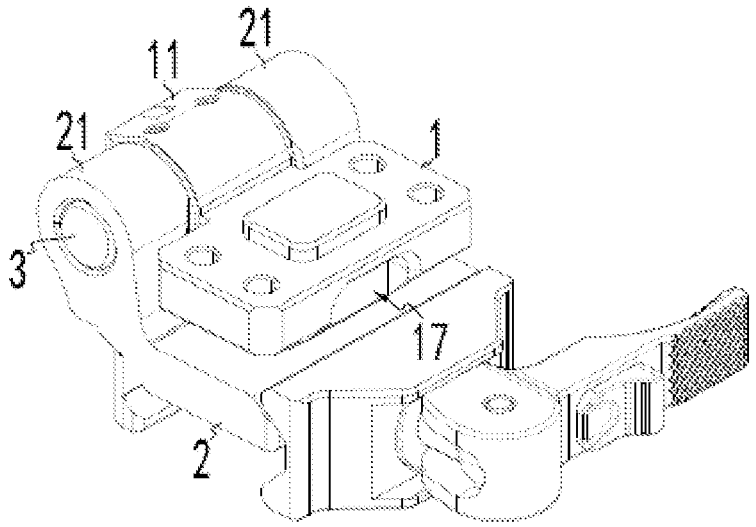
FIG. 1 is an axonometric drawing (a mounting portion is located at a use position) of a turning support for a sight in an embodiment of the present disclosure.
Figure 2:
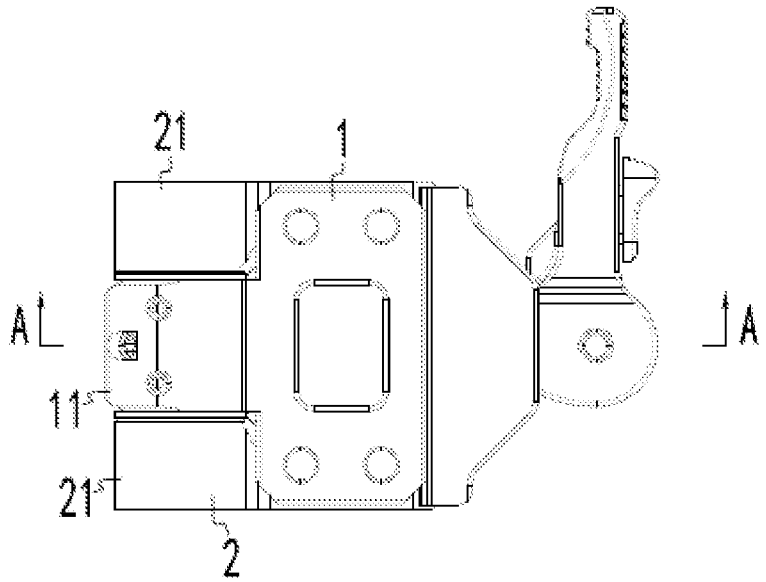
FIG. 2 is a top view (the mounting portion is located at the use position) of the turning support for a sight in the embodiment of the present disclosure.
Figure 3:
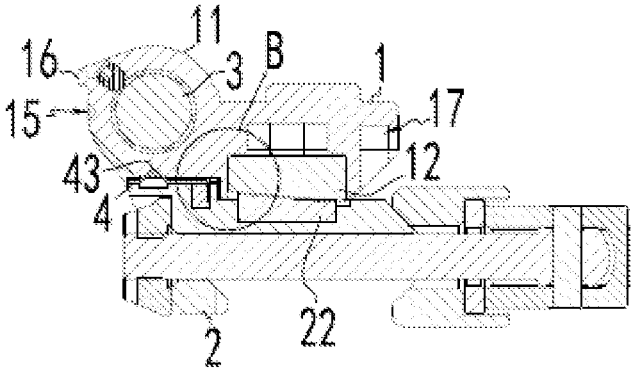
FIG. 3 is a sectional view taken along A-A in FIG. 2.
Figure 6:
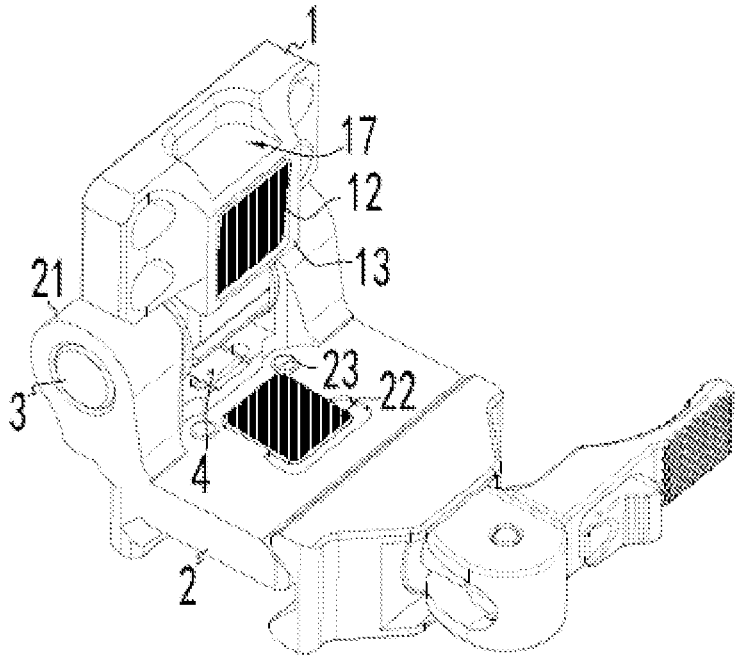
FIG. 6 is an axonometric drawing (the mounting portion is located at a storage position) of the turning support for a sight in the embodiment of the present disclosure.
Figure 7:
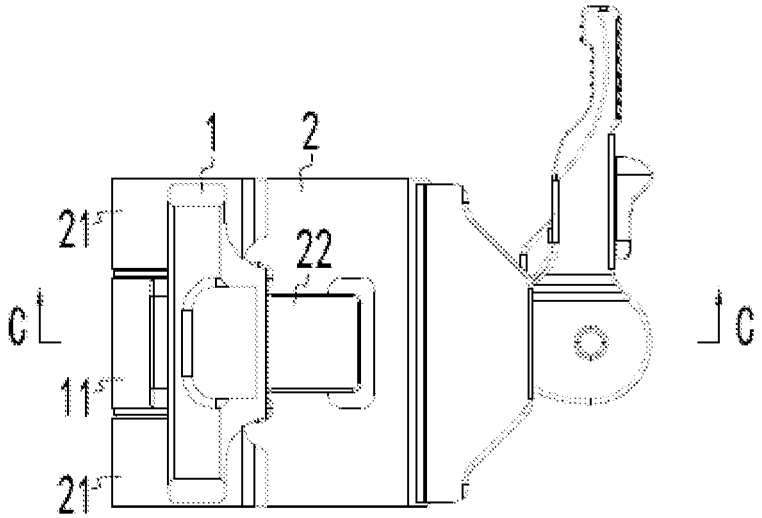
FIG. 7 is a top view (the mounting portion is located at the storage position) of the turning support for a sight in the embodiment of the present disclosure.

As shown in FIG. 1 to FIG. 8, a turning support for a sight in an embodiment of the present disclosure includes the mounting portion 1, the base 2, and the rotating shaft 3. The upper surface of the mounting portion 1 is provided a structure for connecting to a sight, and the lower surface of the base 2 is provided a structure for connecting to a guide rail of a firearm. The supporting portions 21 extending upwards are arranged on an upper surface of the base 2. The pivoting portion 11 is arranged on a side surface of the mounting portion 1. The rotating shaft 3 runs through the supporting portions 21 and the pivoting portion 11, such that the mounting portion 1 can be turned around the rotating shaft 3 relative to the base 2. The lower surface of the mounting portion 1 is located above the base 2. A use position and a storage position are set within a turning trajectory of the mounting portion 1. If the turning support for a sight is mounted on the guide rail of the firearm, when the mounting portion 1 is turned to the use position (as shown in FIG. 1), the upper surface of the mounting portion 1 is approximately parallel to the upper surface of the base 2. In this case, the sight mounted on the upper surface of the mounting portion 1 can enter the field of view of a shooter, such that the shooter can perform aiming through the sight for shooting. When the mounting portion 1 is turned to the storage position (as shown in FIG. 6), the sight mounted on the upper surface of the mounting portion 1 moves out of the field of view of the shooter, such that the shooter can observe the surroundings or perform aiming by using other sights mounted on the guide rail of the firearm. The first magnet 12 is arranged on the lower surface of the mounting portion 1, and the second magnet 22 is arranged on the upper surface of the base 2. When the lower surface of the mounting portion 1 is turned to the use position (as shown in FIG. 3) in the direction towards the base 2, the first magnet 12 and the second magnet 22 are attracted to each other, such that the mounting portion 1 is accurately kept at the use position during the shooting of the firearm. It should be noted that the side surface of the mounting portion 1 refers to a surface adjacent to both the upper surface and the lower surface of the mounting portion 1, such as a left surface or a right surface.

Compared with the prior art, the turning support for a sight can keep the mounting portion 1 accurately at the use position through a magnetic attractive force generated by the mutual attraction of the first magnet 12 on the lower surface of the mounting portion 1 and the second magnet 22 on the upper surface of the base 2. In this way, the mounting portion 1 is prevented from being dislocated or unable to reset after dislocation, which improves the accuracy in the use of the turning support for a sight and the degree of accuracy of the sight.

As shown in FIG. 3, preferably, the attracted surfaces of the first magnet 12 and the second magnet 22 are configured to be inclined and parallel to each other, which increases the area of the interacted surfaces of the first magnet 12 and the second magnet 22, and thus increases the magnetic attractive force generated between the first magnet 12 and the second magnet 22.

Figure 4:
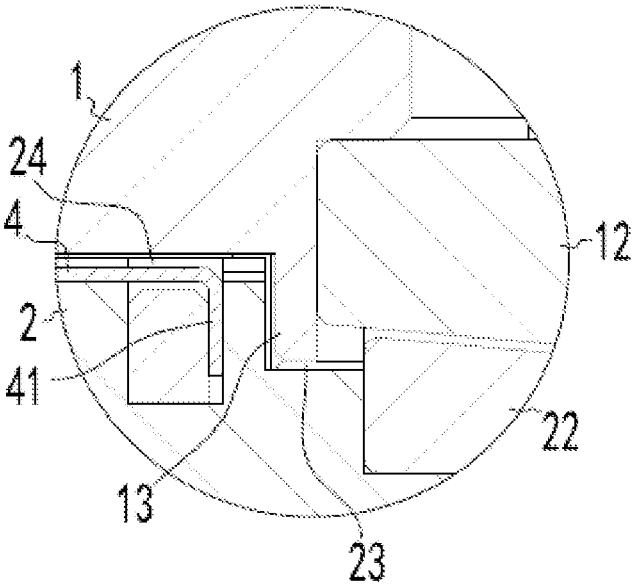
FIG. 4 is an enlarged view of part B in FIG. 3.
Figure 5:
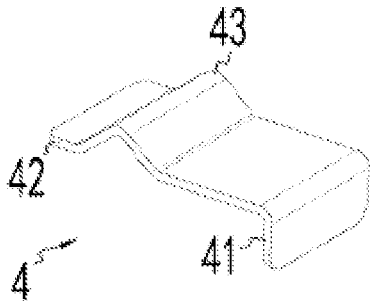
FIG. 5 is a structural view of an elastic piece in the embodiment of the present disclosure.

As shown in FIG. 4 and FIG. 6, in this embodiment, through the fine adjustment screws 23 arranged on the upper surface of the base 2, the mounting portion 1 is capable of being quickly turned to the preset use position and performing a fine adjustment on the preset use position. The part of the fine adjustment screw 23 extending out of the upper surface of the base 2 has an adjustable height. For example, the fine adjustment screw 23 is screwed to the base 2, the top end of the fine adjustment screw 23 protrudes from the upper surface of the base 2, and the stopper 13 is arranged on the lower surface of the mounting portion 1. When the lower surface of the mounting portion 1 is turned to the use position in the direction towards the base 2, the stopper 13 abuts against the top end of the fine adjustment screw 23. From this, when required to be switched to the use position, the mounting portion 1 merely needs to be quickly turned toward the base 2 until the stopper 13 abuts against the top end of the fine adjustment screw 23. Such an operation is convenient and further avoids affecting the use of the sight by preventing the mounting portion 1 from being turned to an inaccurate place. When the preset use position needs to be adjusted, what should be done is to adjust the height of the part of the fine adjustment screw 23 extending out of the upper surface of the base 2 by screwing and unscrewing the fine adjustment screw 23 in and out of the surface of the base 2. If the first magnet 12 and the second magnet 22 both protrude from respective mounting surfaces, the top end of the fine adjustment screw 23 needs to be adjusted to be higher than the highest point of a protruding portion of the second magnet 22 by unscrewing the fine adjustment screw 23 from the surface of the base 2. In this way, when the stopper 13 abuts against the top end of the fine adjustment screw 23, a gap exists between the first magnet 12 and the second magnet 22 which are attracted to each other, such that the first magnet 12 and the second magnet 22 are prevented against cracking caused by a violent collision of them. In some examples, the number of the fine adjustment screws 23 is two, and the two fine adjustment screws 23 are arranged in a way shown in FIG. 6. The number of the fine adjustment screw 23 may also be four, and the four fine adjustment screws 23 defining a quadrilateral are arranged in a way that two more fine adjustment screws 23 are added based on FIG. 6. It can be understood that all the four fine adjustment screws 23 can abut against the stopper 13 to be connected to the stopper 13.

As shown in FIG. 3, in this embodiment, to facilitate assembly of the mounting portion 1, the base 2, and the rotating shaft 3, the mounting portion 1 is detachably connected to the rotating shaft 3. For example, the mounting portion 1 is connected to the rotating shaft 3 through a fastener. In other embodiments, the base 2 is detachably connected to the rotating shaft 3.

Figure 8:
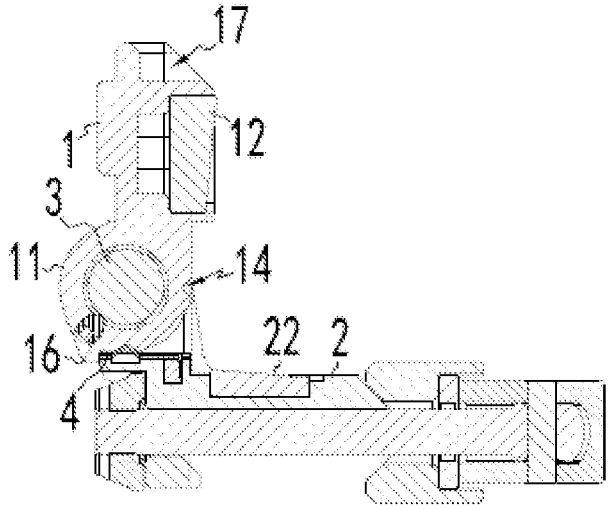
FIG. 8 is a sectional view taken along C-C in FIG. 7.

As shown in FIG. 3 to FIG. 8, in this embodiment, for the sake of more convenience in use, the turning support for a sight further includes the elastic piece 4 with the fixed end 41 and the unfixed end 42. The fixed end 41 is fixed to the upper surface of the base 2. For example, as shown in FIG. 4, the mounting hole 24 is formed in the upper surface of the base 2, the fixed end 41 of the elastic piece 4 is inserted into the mounting hole 24, and an adhesive is injected into the mounting hole 24, such that the fixed end 41 of the elastic piece 4 is fixed in the mounting hole 24 by means of the adhesive. Besides, the fixed end 41 of the elastic piece 4 can also be fixed to the upper surface of the base 2 by welded connection or screw connection. The unfixed end 42 of the elastic piece 4 is provided with the deformable protrusion 43. The pivoting portion 11 is provided with the first groove 14 and the second groove 15 which are open outwards and matched with the protrusion 43. When the mounting portion 1 is located at the use position, the protrusion 43 is inserted into the first groove 14 (as shown in FIG. 3) to fix the mounting portion 1 to the use position. When the mounting portion 1 is located at the storage position, the protrusion 43 is inserted into the second groove 15 (as shown in FIG. 8) to fix the mounting portion 1 to the storage position.

As shown in FIG. 8, in this embodiment, to make the mounting portion 1 be quickly turned to the storage position, the pivoting portion 11 is provided with the flange 16 protruding outwards. When the mounting portion 1 is located at the storage position, the flange 16 abuts against the base 2. From this, when required to be located at the storage position, the mounting portion 1 merely needs to be quickly turned away from the base 2 until the flange 16 abuts against the base 2. Thus, convenience in operation is achieved, and the mounting portion 1 is prevented from being turned to an inaccurate place, which may otherwise lead to shielding of the field of view of the shooter.

As shown in FIG. 8, in this embodiment, to conveniently shift the mounting portion 1 to turn around the rotating shaft 3, a side surface of the mounting portion 1 that is opposite to the rotating shaft 3 is provided with the recess 17 that opens outwards. During the assembly of the turning support for a sight, when the mounting portion 1 needs to be turned to the storage position, a finger or a tool is inserted into the recess 17 to clasp the mounting portion 1 and then shift the mounting portion 1 to turn to the storage position around the rotating shaft 3 away from the base 2.

In another embodiment of the present invention, a sight includes the turning support described above.

The described is only a preferred implementation of the present disclosure, and the present disclosure is not limited to the above-mentioned embodiment. Any implementation should fall within the protection scope of the present disclosure as long as it achieves the technical effect of the present disclosure by any identical or similar means.

What is claimed is:

1. A turning support for a sight, comprising a mounting portion, a base, and a rotating shaft, wherein the mounting portion is hinged with the base through the rotating shaft, a lower surface of the mounting portion is located above the base, and the mounting portion is allowed to be turned around the rotating shaft between a use position and a storage position;

an upper surface of the mounting portion is structurally connected to a sight, and a lower surface of the base is structurally connected to a guide rail of a firearm;

a first magnet is arranged on the lower surface of the mounting portion, and a second magnet is arranged on an upper surface of the base; and when the lower surface of the mounting portion is turned to the use position in a direction towards the base, the first magnet and the second magnet are attracted to each other.

2. The turning support according to claim 1, wherein surfaces of the first magnet and the second magnet are attracted to each other and the surfaces are inclined and parallel to each other.

3. The turning support according to claim 1, wherein a fine adjustment screw is arranged on the upper surface of the base; a top end of the fine adjustment screw protrudes from the upper surface of the base; a stopper is arranged on the lower surface of the mounting portion; and when the lower surface of the mounting portion is turned to the use position in a direction towards the base, the stopper abuts against the top end of the fine adjustment screw.

4. The turning support according to claim 1, wherein the mounting portion or the base is detachably connected to the rotating shaft.

5. The turning support according to claim 1, wherein supporting portions extending upwards are arranged on the upper surface of the base; a pivoting portion is arranged on a side surface of the mounting portion; and the rotating shaft runs through the supporting portions and the pivoting portion, the mounting portion is allowed to be turned around the rotating shaft relative to the base.

6. The turning support according to claim 5, further comprising an elastic piece, wherein the elastic piece has a fixed end and an unfixed end, the fixed end is fixed to the upper surface of the base, and the unfixed end is provided with a deformable protrusion; the pivoting portion is provided with a first groove and a second groove, the first groove and the second groove are open outwards; when the mounting portion is located at the use position, the deformable protrusion is inserted into the first groove; and when the mounting portion is located at the storage position, the deformable protrusion is inserted into the second groove.

7. The turning support according to claim 6, wherein a mounting hole is formed in the upper surface of the base, and the fixed end is fixedly connected to the mounting hole by an adhesive.

8. The turning support according to claim 5, wherein the pivoting portion is provided with a flange protruding outwards; and when the mounting portion is located at the storage position, the flange abuts against the base.

9. The turning support according to claim 1, wherein a side surface of the mounting portion is opposite to the rotating shaft and the side surface is provided with a recess open outwards, and the mounting portion is allowed to be shifted to turn around the rotating shaft away from the base.

* * * * *